United States Patent [19]

Petrov et al.

[11] 4,420,964

[45] Dec. 20, 1983

[54] METHOD OF AND APPARATUS FOR THE PRESSWORKING OF ARTICLES

[75] Inventors: Alexander S. Petrov; Mihail S. Konstantinov, both of Sofia, Bulgaria

[73] Assignee: V M E I "Lenin", Sofia, Bulgaria

[21] Appl. No.: 258,420

[22] Filed: Apr. 28, 1981

[30] Foreign Application Priority Data

Apr. 29, 1980 [BG] Bulgaria ..... 47580

[51] Int. Cl.[3] ..... B21J 9/18

[52] U.S. Cl. ..... 72/451; 72/433; 72/437; 72/452; 83/586; 100/265; 100/291

[58] Field of Search ..... 72/452, 433, 434, 435, 72/436, 431, 407, 450, 451; 425/592, 593; 83/586, 587; 100/265, 291; 74/53

[56] References Cited

U.S. PATENT DOCUMENTS

| | | | |
|---|---|---|---|
| 422,063 | 2/1890 | Bayles | 72/452 |
| 1,956,658 | 5/1934 | Schmidt | 72/451 |
| 2,813,481 | 11/1957 | Hansen | 83/587 |
| 2,832,410 | 4/1958 | Soss | 83/587 |
| 3,427,851 | 2/1969 | Michelson | 72/432 |
| 3,585,837 | 6/1971 | Bihler | 72/452 |
| 4,302,961 | 12/1981 | Leinhaas | 72/451 |
| 4,306,443 | 12/1981 | Matsutani | 72/452 |

FOREIGN PATENT DOCUMENTS

| | | | |
|---|---|---|---|
| 303733 | 2/1955 | Switzerland | 72/451 |

*Primary Examiner*—Gene Crosby

*Attorney, Agent, or Firm*—Karl F. Ross; Herbert Dubno

[57] ABSTRACT

A press and press method wherein an article is shaped by displacing a tool thereagainst in a plurality of time-spaced main strokes separated by intervals in which the energy for the main strokes is stored in a force-storing element such as a rod under tension and during these intervals, the tool continues to be advanced against the article by an auxiliary motor. The apparatus utilizes a lever pivotally connected to a support, to the force-storing element and to the tool. The main drive motor acts on this lever.

7 Claims, 8 Drawing Figures

METHOD OF AND APPARATUS FOR THE PRESSWORKING OF ARTICLES

FIELD OF THE INVENTION

This invention relates to a method for the pressworking of articles and to an apparatus for carrying out the method. More particularly the invention relates to a method for transmitting the amount of energy necessary for the working of a given article by punching, drawing, closed-die forging, extrusion, briquetting, injection molding or other similar processes utilizing metallic and non-metallic materials.

BACKGROUND OF THE INVENTION

There are known methods for the transfer of energy in pressworking, in which the energy is accumulated and transmitted to the article only once for each working stroke of the pressing machine.

There are also known presses utilizing this method and comprising a flywheel for accumulating the energy of their motor, a clutch, and a crank-, eccentric- or cam-type mechanism with a slider for a single release of the required amount of energy to the article.

For some working operations by the known methods there are used mechanical presses which comprise low-inertia motors with transmission gear, a power cam which is in contact with a roll attached to a quaternary (four-hinge) lever system for proportional force transformation, connected to an elastically deformable member, such as a rod or disk springs, for accumulating the required amount of energy and connected to a working member for a single release of this energy to the article.

There are also hydraulic presses which utilize a hydraulic power unit, a hydraulic accumulator and a hydraulic power cylinder for single release of the required amount of mechanical energy to the worked article of metal, plastics, molding powder, granules, etc.

A general drawback of the known methods for effecting the aforementioned production processes is that when greater energy amplitude is necessary for pressworking a particular article, it is necessary to use a more expensive and more powerful press of heavier weight. In the case of presses with a flywheel or with elastic deformable members it is necessary to use a more expensive and more powerful machine of heavier weight also because of the shortness of the power stroke.

Another drawback of the aforementioned flywheel machines is that they operate with impacts and the article cannot be maintained compressed by them in order to subject it to additional treatment, this requiring the use of the more expensive hydraulic presses.

It is possible to utilize from the flywheel of such presses in one working stroke of the slider only a small portion of the total large quantity of kinetic energy accumulated in the flywheel and, moreover, the power stroke, i.e. this portion of their total stroke at which they can release their nominal force, is comparatively short with abrupt transitions.

The power strokes of mechanical presses are comparatively short, their auxiliary stroke is even shorter, and the force is applied to the workpiece according to a decreasing force function, proportional to the reduction of the stress in discharge of the energy elastic deformable member. All this narrows the sphere of application of these presses.

A drawback of the hydraulic presses lies in that they are of heavier weight, are more expensive, more complex and less reliable, slower and with a lower productivity than the mechanical presses, they require a larger floor area, and have a lower energy efficiency because of the repeated energy transformation and the losses for regulation. The simultaneous control of released energies, displacements and velocities is practically not realizable.

OBJECTS OF THE INVENTION

It is therefore a general object of this invention to provide a method for pressworking in which the drawbacks of the known methods are avoided, and which permits repeated release of energy without harmful effects due to the increase of the coefficient of friction between the workpiece and the tool at rest as compared with friction in motion.

Another object is to provide a pressworking apparatus of lower weight and lower power, and higher efficiency, which is less expensive and requires a smaller floor area than the known apparatuses.

It is yet another object to provide such an apparatus which has a long regulable auxiliary stroke with the capacity to release energy over greater portions of this stroke with the function of force transmission being constant or increasing.

SUMMARY OF THE INVENTION

These objects are achieved in a method for transmission of the energy necessary for discrete pressworking of an article, particularly in punching, extrusion, closed-die forging, briquetting, injection molding or other similar processes, in which the transmission of this energy to the workpiece is effected in several steps, each of which comprises a high-power phase with release of previously accumulated potential energy in elastically-deformable energy carriers, and of a low-power phase of longer duration with release of energy from an auxiliary energy source of lower power. The energies, the displacements of the tools and their velocities are conditioned by a previously programmed optimum law for the levels and their transitions between the different phases in which the production process runs, in accordance with the method of the invention, with smoother transitions and is not disturbed because of the fact that the rate of its run during the longer phase of lower power is regulated so that abrupt increase of the coefficient of friction between the workpieces and the tools is avoided, while the velocities of the latter do not alter their sign till the completion of the working of the articles.

During the low-power phase of longer duration a recharging with potential energy of the elastically-deformable energy carriers is effected, and then it is possible to effect the next step of pressworking on the same article.

The press of the invention uses low-inertia motors and a transmission gear for driving the power cam which is in contact with a roll attached to a quaternary lever, hinge-connected to another rigid support, an elastically-deformable member and connected at its fourth point to a member for connection to a working reciprocating unit carrying the working tool, while the power cam has at least one sector for accumulating energy in the elastically-deformable member and one sector for release of energy from the elastically-deformable member. The member for connection to the reciprocating unit is a hinged connecting rod, and the mutual arrangement of the hinge joints of the quaternary lever with the rigid support, with the elastically-deformable member and with the hinged connecting rod is such that the quaternary lever is a functional force-varying member and the hinged connecting rod is composed of two hinge-connected semi-rods, and the hinge between both semi-rods can be shaped as a nut which is connected to a driving screw driven by an auxiliary regulable motor with a gear transmission.

The press apparatus comprises a quaternary lever, the force-transmission function of which is regulable by the choice of the mutual arrangement of the hinges of the quaternary lever, where the angle between the initial position of the hinge of the elastically-deformable member, the hinge of the rigid support, i.e. the base, and the hinge in which the hinge-type connecting rod is attached in its distant end, with respect to the working member, is less than 90°, but is greater than the angle of the oscillatory motion of the quaternary lever, while the angle between the hinge of the elastically-deformable member, the rigid support (i.e. the base) and the other more distant point of attachment of the elastically-deformable member is greater than the angle of the oscillatory motion of the quaternary lever.

The press apparatus can comprise a two-part reciprocal unit, and its both parts can be connected in-between by means of a driving screw with a nut, connected to an auxiliary motor with reduction gearing, and this motor can be regulable.

The press apparatus can also include a program-control device which coordinates the sectors of the power cam with the positions of the hinged connecting rods, or the positions of the driving screw.

The press apparatus may also comprise more than one set of quaternary levers, elastically-deformable members and hinged connecting rods, which can be arranged symmetrically and can be driven centrally while the screws connected to the intermediate joints of the hinged connecting rods can be provided with left-hand and right-hand threads.

The crank hinge can be shaped as a cylindrical hinge, connected to a transverse lever, which in its other end is hinge-connected to a driving lever with a regulable hinged support. At the other end of the driving lever there is a roll which is kept in forced contact with an auxiliary cam. This cam is integrated or synchronized with the power cam and has one sector with decreasing radius from a maximum to a minimum size, which is followed by another sector with increasing radius from a minimum to a maximum size, and these two sectors have a corresponding sector in phase and size of the power cam with increasing radius. The latter is called the sector for energy accumulation. Then the auxiliary cam has a last sector with a constant radius, which corresponds to a sector of the power cam and which is called the sector for energy release. The regulable hinged support is fastened in a preset setting position with respect to the plane of the frame of the press and is fixed in a groove within the driving lever by means of a common lock so that the plane is parallel to the position of the driving lever in its end position when the connecting rod is straight.

The advantages of the invention lie, on one hand, in the low power of the driving motors required, the reduced weight, the smaller floor area and the lower price of the press apparatus, since between the short time intervals with intensive energy release there are long time intervals for intermediate accumulation of energy in the elastically-deformable member, during which time only a small amount of energy is transmitted to the workpiece without interruption of the production process and without permitting the coefficient of friction between the tool and the workpiece in motion to grow to its magnitude at rest. The productivity of the press apparatus is commensurate with that of the known machines of heavier weight. The causes for this are two:

(1) the net machine time in the case of working articles consuming more energy is small as compared to the auxiliary time for inserting the workpieces and the removal of the pressed articles, and (2) the regulable motors in combination with the program-controlled device can be adapted more flexibly to the loads corresponding to the worked articles of different type. An advantage over hydraulic presses is that the auxiliary stroke of the press apparatus is faster and its regulation is free of losses; this is achieved without a long hydraulic cylinder, which must develop a great force only at the end of its stroke, and has a large diameter and volume which is filled with oil unnecessarily and slowly with poor efficiency.

An advantage, with regard to mechanical presses is that in the case of insufficiency of pressing force it is possible to operate with a smaller force and longer stroke, by bevelling the punches for example, or by reducing the cross-section of the outflowing material, etc.

BRIEF DESCRIPTION OF THE DRAWING

For a better understanding of the invention, reference should be made to the accompanying drawings in which there are illustrated preferred embodiments of the invention. In the drawing.

SPECIFIC DESCRIPTION

Figure 1:
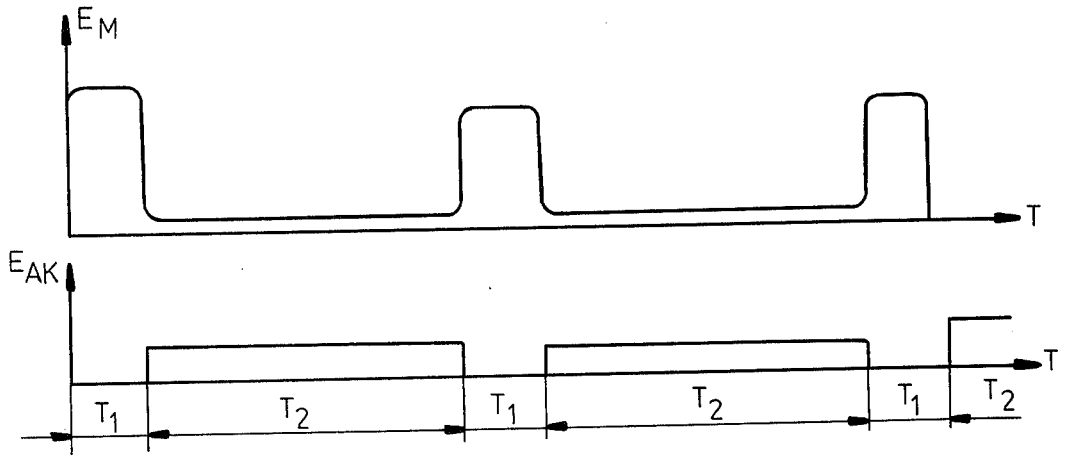
FIG. 1 is an energy $E_M$ vs. time T diagram according to the method of repeated release of energy by the elastically-deformable member and by the auxiliary drive on the workpiece together with an energy $E_{ak}$ vs. time T diagram showing energy accumulation by the motor in the elastically-deformable member.

It can be seen from FIG. 1 that for a short time interval $T_1$ there is transmitted to the workpiece a given amount of energy $E_M$ by the elastically-deformable member. Then follows a time interval $T_2$ of relative long duration during which there is transmitted to the workpiece a small amount of energy at the expense of the auxiliary drive while at the same time there is accumulated in the elastically-deformable member at the expense of the main drive a new quantity of energy $E_{ak}$ which in the next-following time interval $T_1$ is transmitted in its turn to the workpiece and so forth, and after the time interval $T_1$ concluding the pressworking, during the next-following time interval $T_2$ there may eventually occur a pause for auxiliary operations without energy release.

Figure 2:
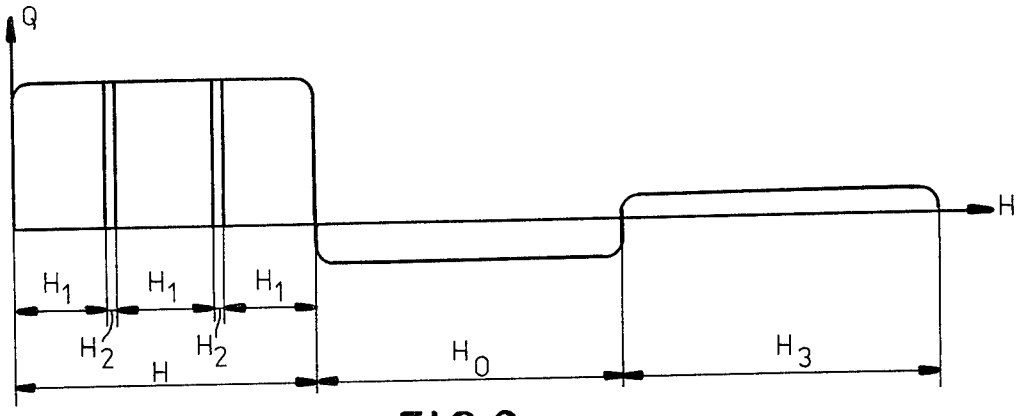
FIG. 2 is a force Q vs. stroke H diagram for the working member.
Figure 3:
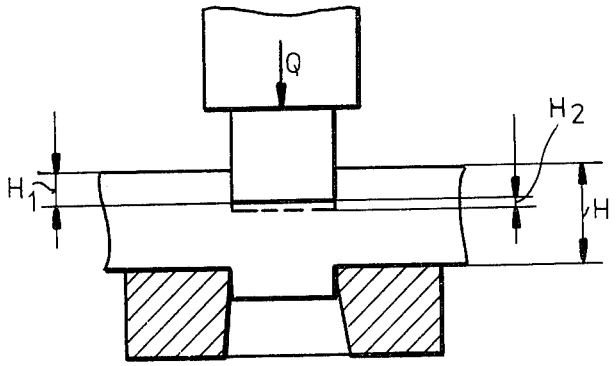
FIG. 3 is a diagrammatic section of the working tool for the case of punching in accordance with the method of the invention.

FIG. 2 shows an example for constant pressing force Q which is applied to the workpiece, and the summed-up power stroke H of the working member is composed by sectors $H_1$ (passed during the time intervals $T_1$ at great energy release at the expense of the elastically-deformable member) and by the sectors $H_2$ (passed during the intermediate time intervals $T_2$ at low speeds and at a very low energy release at the expense of the auxiliary drive). Then follow an opening auxiliary reverse stroke $H_o$ (the force Q reverses its magnitude and its sign) which can be a pause for replacement of the workpiece, and a direct auxiliary closing stroke $H_3$.

Figure 4:
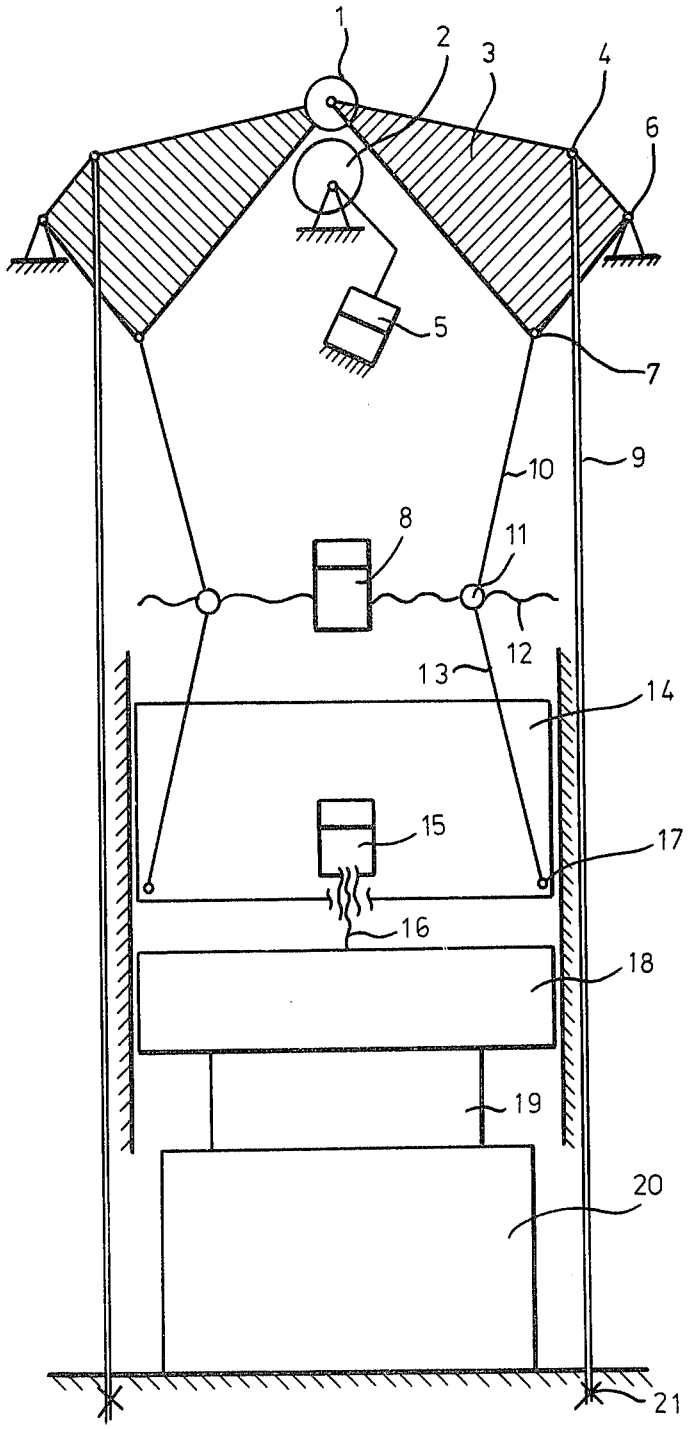
FIG. 4 is a kinematic diagram of a press apparatus of vertical design.

The press apparatus operating according to the invention shown in FIG. 4 comprises one or more low-inertia motors (i.e. main motors) 5 with gearing for driving the power cam 2, which is in contact with a roll 1, attached to a quaternary lever 3, which is also hinge-connected at 6 to a rigid support, i.e. a base. An elastically-deformable member 9 which can be a rod in tension, for example is connected at a hinge 4 to the lever 3 which is connected at its fourth point 7 to a member 10, 13 for joining to a working reciprocating unit 14, 18, carrying the movable half 19 of the working tool. In FIG. 4, the numeral 19 represents a tool juxtaposed with the article subjected to press working. The power cam 2 has at least one sector for accumulating energy (at constant torque of its shaft, for example) in the elastically-deformable member and has one sector for release of its energy in accordance to a desired law. The member for joining to the reciprocating working unit 14, 18, is a hinged connecting rod 10, 13, and the mutual arrangement of the hinge joints of the quaternary lever 3 with the rigid support, with the elastically-deformable member 9 and with the hinged connecting rod 10, 13, is such, that the quaternary lever 3 is a functional force-varying member, and the hinged connecting rod 10, 13, is composed of two hinge-connected rods 10, 13. The hinge 11 between rod 10 and rod 13 has a nut, which is connected to a driving screw 12 driven by an auxiliary regulable motor 8 with gearing.

The rods 10, 13 and motor 8 form connecting means pivotally linked to the tool operable between main strokes of the tool for continuously advancing the tool at low energy between main strokes.

The force-transmitting function of the quaternary (four-pivot) lever 3 is regulatable by the choice of the mutual arrangement of the hinges or pivots 4, 6 and 7 of the quaternary lever 3, where the angle between the initial position of the hinge 7, the hinge 6 to the rigid support and the hinge 17 which the hinged connecting rod or toggle linkage 10, 13 is attached to the working member 14, 18 is smaller than 90°, but is greater than the angle of the oscillatory motion of the quaternary lever 3. The angle between the pivot 4 of the elastically-deformable force-storing member 9, the rigid support and the other point 21 of attachment of the elastically-deformable member 9 is greater than the angle of the oscillatory motion of the quaternary lever 3.

The reciprocating working unit 14 is a two-part unit and its additional component 17 is connected to the component 14 by means of a driving screw 16 with a nut driven by a regulatable auxiliary motor 15 with gear reduction.

The coordination between the sectors of the power cam and the positions of the hinged connecting rods 10, 13 or the positions of the driving screw 16 is effected by a program-control device.

The quaternary levers 3, the elastically-deformable members 9 and the hinged connecting rods 10, 13 can be provided in more than one set. They can be arranged symmetrically and can be provided with a central drive 8 for the screws 12 which can be formed with left-hand and right-hand threads.

Figure 7:
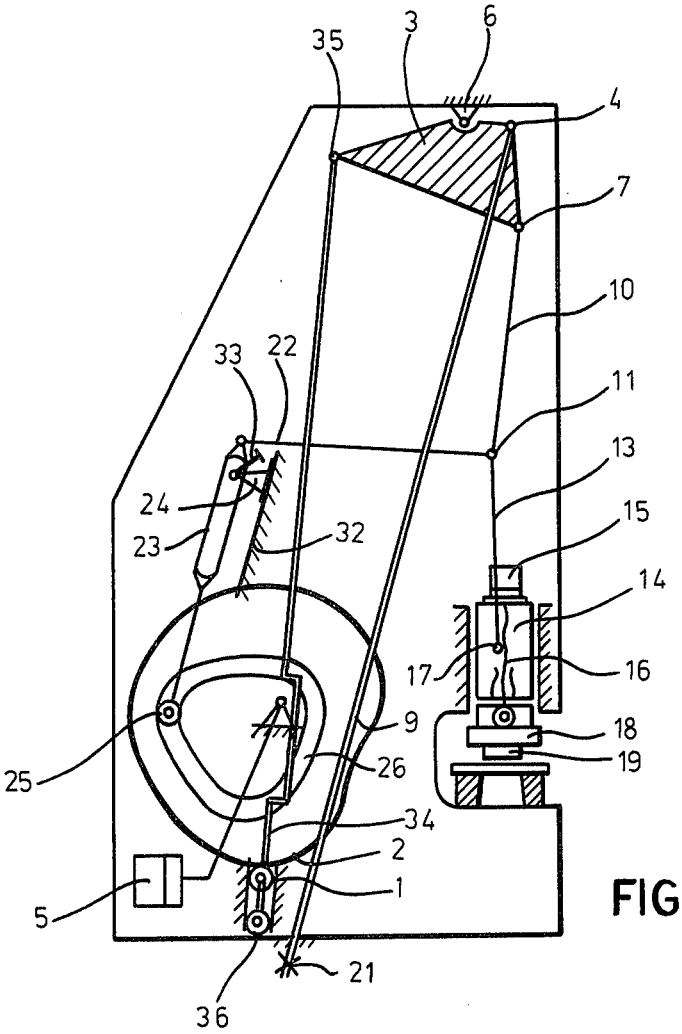
FIG. 7 is a diagram of the kinematic system of a press apparatus with auxiliary cam mechanism for driving the hinged connecting rods and with an auxiliary regulable motor with a screw mechanism for regulating the distance between both parts of the two-part reciprocating working member.

The press shown in FIG. 7 is shaped as an open-frame machine with one elastically deformable member 9, one quaternary (four-pivot) lever 3 and one power cam 2.

The crank hinge 11 of the rods 10 and 13 is in this case a cylindrical hinge, connected to one end of a transverse lever 22, the other end of which is connected to a driving rocking lever 23. This lever 23 is supported by a regulatable pivot 24, which can be displaced along a plane 32, which is parallel to the position of the driving lever 23 in its end position when the connecting rod 10, 13 is straight.

The support 24 is provided with a lock 33 for positioning it with respect to the plane 32 and for setting of the magnitude of the limit angle of the hinged connecting rods 10, 13 at their point of hinge connection with the object to achieve a different degree of opening of the tool 19.

The rocking lever 23 carries at its other end an auxiliary cam-follower roller 25 which is brought into forced contact with the auxiliary cam 26, shaped as an internal auxiliary groove of the power cam 2 or synchronized with it.

The power cam 2 also is in contact externally with the main cam-follower roller 1, which is attached to a pull lever 34. One end of lever 34 is connected pivotally to the quaternary lever 3. Its other end is provided with an additional roller 36 guided along rigid guideways defining a linear path for the main cam follower roller 1. In the upper part 14 of the two-part reciprocating member there is mounted a geared regulatable motor 15 which drives the screw mechanism 16 for varying the distance between the upper part 14 and the bottom part 18.

Figure 8:
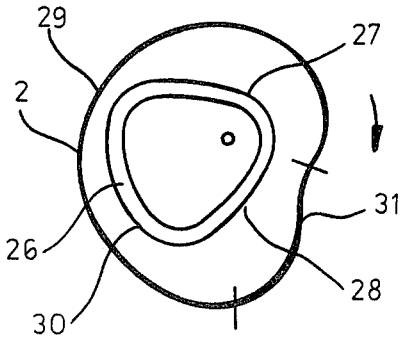
FIG. 8 is an elevator of the power and the auxiliary cams of the apparatus illustrated in FIG. 7.

The power cam 2 and the auxiliary cam 26 are illustrated separately in FIG. 8. The auxiliary cam has a sector 28 with radius decreasing from a maximum to a minimum, followed by another sector 27 with radius increasing from a minimum to a maximum. To these two sectors there corresponds in phase and size a sector 29 of the power cam 2 with a radius which increases according to a desired law and is the sector for accumulation of potential energy in accordance with this desired law in the elastically-deformable member 9.

Further, the auxiliary cam 26 has a final sector 30 with constant radius centered on the axis of rotation, which is the arc of rest. To this sector there corresponds in the power cam 2 in size and phase a final sector 31 of radius decreasing according to another desired law, which is the sector for energy release according to a desired law by the elastically-deformable member 9 to the hinged connecting rod 10, 13.

The operation of the apparatus in accordance with the method of the invention as illustrated in FIG. 4 is as follows:

The low-inertia motor 5 rotates the power cam 2 and the cam-follower roller 1 rides up in its accumulating sector. The elastically-deformable member 9 is stretched and potential energy is accumulated in each such deformable member. At the same time the auxiliary motor 8 drives the screw 12 with left-hand and right-hand threads to displace the nuts of the hinges 11 which come closer together. The reciprocating actuating unit 14, 18 climbs upwards, this corresponding to the opening of the tool 19. If there is no automatic workpiece supply, it is possible to create a pause by switching-off the motors 5 and 15 for the replacement of workpieces. If not, the auxiliary motor 15 is reversed and the tool is closed as long as the further energy accumulation in the elastically-deformable members 9 takes place.

After the performance of the described opening stroke $H_0$ and the closing stroke $H_3$ (FIG. 2), there follows the power stroke $H_1$ in time interval $T_1$, during which the power cam brings its energy release sector into engagement by the rollers 1, this sector being shaped in accordance to a desired law of energy release, the quaternary levers 3 rotate in opposite directions under the action of the elastically-deformable members which are being shortened, i.e. rods 9, and the force is transmitted by means of the hinged connecting rods 10, 13 to the upper component 14 of the working unit. During this time the drive 8 can be switched-off.

The tool 19 performs a power stroke $H_1$ upon the workpiece. If this stroke is not sufficient, then the program-control device (which is not shown in the drawing) gives commands to the motors 5 and 8, and energy is accumulated anew in the elastically-deformable members 9, the points 7 of attachment of the hinged connecting rods 10, 13 to the quaternary levers 3 climb upwards under the action of motor 8, the working unit 14, 18 drives the movable part 19 of the tool into the workpiece at a very low (creeping) speed to an additional depth $H_2$ during the prolonged time interval $T_2$ so that the tool does not stop and no harmful effect due to the increase of the coefficient of friction between the tool and the workpiece at rest, as compared to the coefficient of friction in motion, can occur.

By command from the program-control device there follows a new power stroke $H_1$, a new short stroke $H_2$ and so on until the processing of the workpiece is complete. The program-control device receives information for the different parameters of the production process from respective transducers (which are not shown in the drawing), and can be set eventually to operate also by a fixed program.

In principle, the creeping speeds during the energy accumulating time interval $T_2$ can also be realized by means of the auxiliary motor 15. In the general case the latter mechanism is used for adjustment, i.e. for the adjustment of the closed height of the apparatus depending on the different heights of the tools.

The operation of the embodiment of the press apparatus shown in FIG. 7 with cams as shown in FIG. 8 is similar. The cams are shown in a moment when the auxiliary closing stroke $H_3$ is ending and the power stroke $H_1$ is imminent, i.e. the hinged connecting rods 10, 13 are in straight position.

In this position the tool 19 almost touches the material (the illustration shows as example a punching tool and sheet material).

During the time interval $T_1$ the main cam-follower roller 1 rolls over the release sector 31 of the power cam 2 (in the illustrated example the direction of rotation of the latter is clockwise) because of the shortening of the elastically-deformable member, which is a rod 9, accompanied by the release of the accumulated energy, and the hinges 4, 7, 11 and 14 come down (the latter with displacement $H_1$), while the auxiliary cam-follower roller 25 rolls over the arc of rest, i.e. the sector 30 of the auxiliary cam 26. During this movement, however, the rocking lever 23 and the transverse lever 22 remain immovable.

During the next-following time interval $T_2$ the auxiliary roller 25 approachs over the sector 28 the axis of the auxiliary cam 26, the rocking lever 23 rotates around its support 24 and displaces the transverse lever 22 to the left together with the crank hinge 11, and the upper part 14 of the working member is lifted upwards.

During this time the main cam-follower roller 1 rolls over the energy accumulating sector 29 of the power cam 2 and in the elastically-deformable member 9 there is accumulated potential energy developed by the main motor 5, while the auxiliary motor 15 is then controlled by the program-control device so that the bottom part 18 of the two-part working unit not only does not move upwards, but the tool 19 continues to penetrate into the material at creeping speed. Then the auxiliary roller 25 begins to move away from the axis of the auxiliary cam 26 over the sector 27, the rods 10, 13 come again in straight position, the upper part 14 moves downwards, the auxiliary motor 15 is reversed and the distance between the parts 14 and 18 diminishes, while the tool 19 continues to penetrate at creeping speed in the material as the main cam-follower roller 1 continues to ride over the accumulating sector 29.

Then the process is repeated several times according to the method to completion of the punching operation (it is assumed that the sheet material is thick and the punch is bevelled).

Then the auxiliary motor 15 rotates so that both parts 14 and 18 approach, while the auxiliary cam-follower roller 25 rolls over the opening sector 28 and the auxiliary stroke $H_0$ is effected, new material is supplied (with or without stopping the press apparatus at the end of this stroke) and then follows a new closing of the tool with auxiliary stroke $H_3$, while the cam-follower roller 25 rolls over the closing sector 27.

When working a thin material, if the energy of the elastically-deformable member 9 is sufficient for effecting the punching during one revolution of the cams 2 and 26 and it is not necessary to apply the method, then the auxiliary motor 15 is switched-off (it is used only for setting purposes in the case when the tools 19 are of different height) and the auxiliary strokes for opening $H_0$ and closing $H_3$ are effected only by the kinematic members: auxiliary cam 26-cam-follower roller 25-rocking lever 23-transverse lever 22-crank hinge 1'.

The magnitude of these auxiliary strokes is determined in this case only by the position in which the regulatable support 24 is locked by means of its lock 33 with respect to the plane 32 oriented so that regardless of the position, the end right position of the crank hinge 11 remains always the same, i.e. its position as the roller 26 rolls over the sector of rest, i.e. the sector 30 of the auxiliary cam 26, the purpose being to effect the power stroke at immovable rocking lever 23.

The deeper the regulatable support 24 is fastened, the more the rods 10, 13 bend at their hinge connection 11 and the more the tool is opened. This is appropriate for the working of voluminous workpieces (for the ribbing of sheet metal components, for example). However, then the main regulatable motor 5 rotates slower, thus facilitating the operation of the auxiliary motor.

Figure 6:
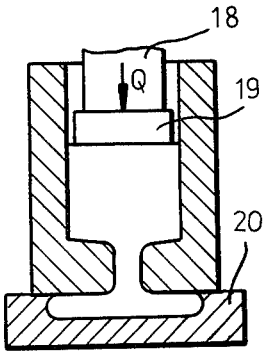
FIG. 6 is a section of a working tool for the case of injection molding of plastics by the method of the invention, for example.

In the example shown in FIG. 6, which is an apparatus for injection molding of plastics, the movable part of the tool 19 is shaped as a ram which forces the material through a cylinder (surrounded by heaters which are not shown in the drawing) into the mold 20. If the energy of the elastically-deformable member 9 is sufficient for the filling of the mold 20 with material, there should follow an opening stroke and replacement of the filled mold by a new empty mold; otherwise the filling must be carried out in several subsequent steps according to the described method. If it is necessary to maintain the mold 20 with the molded article under pressure for a given time (for heat treatment of the article within the mold, for example), then motors 5 and 8 are switched-off for this time and the pressure is produced by the stress of the elastically-deformable members 9.

Figure 5:
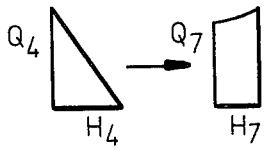
FIG. 5 shows force $Q_4$ vs. deformation $H_4$ diagrams of the elastically-deformable member at the input of the quaternary lever, which acts as a functional force-varying member, and "force $Q_7$ applied in the axis of the connecting rod vs. power stroke $H_7$" for one oscillatory stroke of the quaternary lever.

By the described arrangement of the hinges of the quaternary levers 3 during the energy release interval $T_1$ the projections of the hinges 4 on the horizontal plane passing through the rigid supports, i.e. the bases 6, move away from these hinge supports. The components of the forces with which the elastically-deformable members 9 tend to rotate the quaternary levers 3 downwards increase, while these forces decrease. At the same time the projections of hinges 7, through which the quaternary levers 3 transmit the working force to the hinged connecting rods 10, 13 are moved closer to the hinge supports 6. Thus, despite the fact that during the energy release time interval $T_1$ the input function of the hinge 4 "force $Q_4$-deformation $H_4$" is increasing (see FIG. 5), the output function of the quaternary lever 3 on its hinge 7 "force $Q_7$-stroke $H_7$" can be either constant or of increasing character, which is favorable for a large number of production processes.

This property of the quarternary lever 3 is at the same time also a prerequisite for the method of operating the apparatus shown in FIG. 4 during the time intervals $T_2$. Then the tool penetrates into the workpiece at small depth, at low speed and small energy at the expense of the auxiliary drive, while the hinges 7 are subjected to the nominal working force. However, the auxiliary motors are not a help to the main motors 2 because of the functional features of the thus described quaternary levers force-varying members 3. This can happen only if the reverse force becomes greater than the limit $Q_7$ in the upper part of the diagram shown in FIG. 5, and this is controlled by the program-control device.

We claim:

1. A method of operating an apparatus for the press working of an article in which a movable tool member is urged against said article, said method comprising the steps of (a) storing force in a force-storing element over a first time interval;

(b) driving said tool against said article with force stored in said element during a second time interval;

(c) storing force in said element during a third time interval immediately following said second time interval while simultaneously and independently of the storage of force in said element, maintaining the advance of said tool against said article; and (d) repeating steps (b) and (c) at least once.

2. An apparatus for the press working of an article comprising:

a tool juxtaposed with said article;

a lever;

connecting means pivotally linked to said lever and operatively connected to said tool and including an auxiliary motor operable between main strokes of said tool for continuously advancing said tool at low energy during intervals between said main strokes;

means for pivotally connecting said lever to a support;

a force-storing element pivotally connected to said lever and stressable by displacement of said lever for applying force to said lever sufficient to drive said tool for said main strokes; and a main motor provided with a cam acting upon said lever for displacing said lever to stress said element, said cam having a portion enabling release of energy stored in said element to said lever and by said lever via said connecting means to said tool for said main strokes.

3. The apparatus defined in claim 2 wherein said element is a rod pivoted at one end to said lever and fixed at its opposite end, said rod being stressable under tension.

4. The apparatus defined in claim 2 wherein said connecting means includes a toggle linkage having a first rod pivotally connected to said lever, a second rod operatively connected to said tool and articulated to said first rod, and a nut provided at the articulation of said first and second rods, said auxiliary motor being provided with a screw for displacing said nut.

5. The apparatus defined in claim 3 wherein said connecting means includes a toggle linkage having a first rod pivotally connected to said lever, a second rod operatively connected to said tool and articulated to said first rod, and a nut provided at the articulation of said first and second rods, said auxiliary motor being provided with a screw for displacing said nut.

6. The apparatus defined in claim 5 which comprises a second assembly of such a lever, force-storing element and first and second rods connected by a nut, said auxiliary motor driving the nuts of both assemblies.

7. The apparatus defined in claim 2 wherein said connecting means includes a tool holder and auxiliary motor, said auxiliary motor displacing said tool relative thereto.

* * * * *